US009044690B2

(12) United States Patent
Uttley et al.

(10) Patent No.: US 9,044,690 B2
(45) Date of Patent: Jun. 2, 2015

(54) BUILDING SYSTEM

(71) Applicant: Pitsco, Inc., Pittsburg, KS (US)

(72) Inventors: Paul W. Uttley, Pittsburg, KS (US); Stephan S. Turnipseed, Plke Road, AL (US)

(73) Assignee: PITSCO, INC., Pittsburg, KS (US)

( * ) Notice: Subject to any disclaimer, the term of this patent is extended or adjusted under 35 U.S.C. 154(b) by 148 days.

(21) Appl. No.: 13/838,079

(22) Filed: Mar. 15, 2013

(65) Prior Publication Data

US 2014/0273712 A1 Sep. 18, 2014

(51) Int. Cl.

| | |
|---|---|
| ***A63H 33/12*** | (2006.01) |
| ***A63H 33/10*** | (2006.01) |
| ***A63H 33/04*** | (2006.01) |

(52) U.S. Cl.

CPC ..... *A63H 33/102* (2013.01); *A63H 33/107* (2013.01); *A63H 33/042* (2013.01); *A63H 33/101* (2013.01); *A63H 33/12* (2013.01)

(58) Field of Classification Search

USPC ..... 446/85, 108, 111, 112, 113, 115, 116, 446/120, 122, 123; 403/108, 408.1

See application file for complete search history.

(56) References Cited

U.S. PATENT DOCUMENTS

| | | | | | |
|---|---|---|---|---|---|
| 2,885,822 | A * | 5/1959 | Onanian | ..... | 446/121 |
| 3,611,609 | A * | 10/1971 | Reijnhard | ..... | 446/121 |
| 5,322,466 | A * | 6/1994 | Bolli et al. | ..... | 446/121 |
| 5,964,635 | A * | 10/1999 | Krog | ..... | 446/120 |
| 6,322,414 | B1 * | 11/2001 | Lin | ..... | 446/122 |
| 7,517,270 | B2 * | 4/2009 | Marzetta | ..... | 446/122 |
| D603,910 | S | 11/2009 | Uttley et al. | | |
| 7,736,211 | B2 * | 6/2010 | Marzetta | ..... | 446/122 |
| 7,942,717 | B2 * | 5/2011 | Chou | ..... | 446/91 |
| 8,240,939 | B2 | 8/2012 | Uttley et al. | | |
| D715,871 | S * | 10/2014 | Norman et al. | ..... | D21/487 |
| D720,408 | S * | 12/2014 | Webb | ..... | D21/484 |

OTHER PUBLICATIONS

The Surface Mobility Platform, printed from www.gearseds.com/surface_mobility_platform.html on Nov. 28, 2012; copyright 2011 DEPCO, LLC (2 pages).

* cited by examiner

*Primary Examiner* — Kurt Fernstrom
(74) *Attorney, Agent, or Firm* — Hovey Williams LLP

(57) ABSTRACT

A building system includes connectors for quickly and easily interconnecting building system parts. An expansion connector engages the apertures of two parts and expands to connect the parts. The expansion connector includes a base, an expansion element extending from a first side of the base and a receptacle extending from a second side of the base. A pin is configured to be inserted through the receptacle and the base and into engagement with the expansion element to force the expansion element into an expanded position. An alignment post may extend from the first side of the base to orient the connector relative to the parts and strengthen the connection. A thumbscrew connector includes at least one flange to engage an aperture of at least one part and includes a threaded receptacle for receiving a thumbscrew which secures the connector to the part or parts.

18 Claims, 15 Drawing Sheets

BUILDING SYSTEM

FIELD

Embodiments of the present invention relate to building systems. More particularly, embodiments of the present invention relate to toy or model building systems including a plurality of interconnectable parts configured to be quickly and easily assembled and disassembled.

BACKGROUND

Toy or model building systems including multiple interconnectable parts are commonly used for entertainment, educational and/or research purposes. The LEGO® brand system of building blocks and the TETRIX® brand robot building system, for example, include various types of parts that can be interconnected in different ways to build different structures. Such building systems may be designed for general use and/or for assembling particular types of structures, including architectural structures, vehicles or robots.

These building systems may include parts that are configured to be quickly and easily connected and disconnected by hand for ease of use. LEGO brand building blocks, for example, are typically interconnected with a friction fit and thus can be connected and disconnected by simply applying force. Such systems are easy to use, even for young children, but have very limited structural integrity. Other systems have been designed with stronger interconnection mechanisms such as screws, bolts or other fasteners. These systems provide greater overall structural integrity but require more skill and/or strength to use, and therefore may be difficult or inconvenient for all users and may be impractical for use by children.

The above section provides background information related to the present disclosure, and is not necessarily prior art.

SUMMARY

A connector constructed in accordance with an embodiment of the present invention comprises a base with an expansion element extending from a first side of the base and a receptacle extending from a second side of the base. The expansion element includes a plurality of flexible sections in circumscribing relationship to an aperture in the base. Each of the flexible sections includes an outer lip extending outwardly from a portion of the section distal the base and an inwardly-extending inner lip. The receptacle defines a through-hole in register with the aperture. One or more alignment posts extend from the first side of the base. A pin is configured to be inserted through the receptacle and into engagement with the expansion element wherein the pin engages the inner lips of the expansion element and forces the flexible sections outward.

A building system in accordance with another embodiment of the invention comprises a first part including a wall defining a first aperture and a second aperture, a second part including a wall defining a first aperture and a second aperture, and a connector configured to interconnect the first part and the second part.

The connector includes a base with a base aperture and an expansion element extending from a first side of the base. The expansion element includes a plurality of flexible sections in circumscribing relationship to the base aperture, wherein each of the flexible sections includes an outer lip extending outwardly from the section. The expansion element is configured to be inserted through the first aperture of the first part and the first aperture of the second part such that the wall of the first part and the wall of the second part are locked into position between the base and the outer lips of the connector. An alignment post extending from the first side of the base is configured to engage the second aperture of the first part and the second aperture of the second part when the expansion component is in locking relationship with the first wall and the second wall.

A receptacle projects from a second side of the base and defines a through-hole in register with the base aperture. A pin is slidably positioned within the receptacle such that a portion of the pin extends through the base aperture and forces at least a portion of each of the flexible sections outward such that the outer lips define an outer perimeter that is larger than a radius of each of the first apertures of the first and second parts.

A building system in accordance with yet another embodiment of the invention comprises a part including a wall having a plurality of large apertures and a plurality of small apertures and a connector configured to engage one of the apertures and be secured to the part via a thumbscrew. The large apertures present a uniform size and shape and the small apertures present a uniform size and shape wherein the apertures are arranged according to a pattern wherein each of the small apertures is proximate at least one of the large apertures.

The connector includes a base, a flange extending from a first side of the base and configured to engage any one of the large apertures, and a threaded receptacle in the base positioned to be in register with one of the small apertures when the flange engages any of the large apertures. The thumbscrew includes a head and a shank, at least a portion of the shank being threaded, the shank configured to extend through any one of the small apertures and to fixedly engage the threaded receptacle of the connector.

A building system in accordance with yet another embodiment of the invention comprises a first part including a plurality of walls defining an inner channel wherein at least one of the walls includes at least one large aperture and at least one small aperture, a second part having a wall defining at least one large aperture and at least one small aperture, and a connector configured to interconnect the first part and the second part.

The connector includes a body with an outer shape corresponding to the shape of the inner channel of the first part such that at least a portion of the body may be fittingly positioned within the inner channel. A first flange extends from the body and engages the large aperture of the first part when the body is fittingly positioned within the inner channel of the first part. A second flange extends from the body and is configured to engage the large aperture of the second part when the when the body is fittingly positioned within the inner channel of the first part and the first flange is engaging the large aperture of the first part.

The connector also includes a first threaded receptacle and a second threaded receptacle. A first thumbscrew is configured to extend through the small aperture of the first part and matingly engage the first threaded receptacle when the connector body is fittingly positioned within the inner channel to thereby fixedly secure the connector to the first part. A second thumbscrew is configured to extend through the small aperture of the second part and matingly engage the second threaded receptacle of the connector when the connector body is fittingly positioned within the inner channel to thereby fixedly secure the connector to the second part.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

DRAWINGS

Embodiments of the present invention are described in detail below with reference to the attached drawing figures, wherein.

Figure 1:
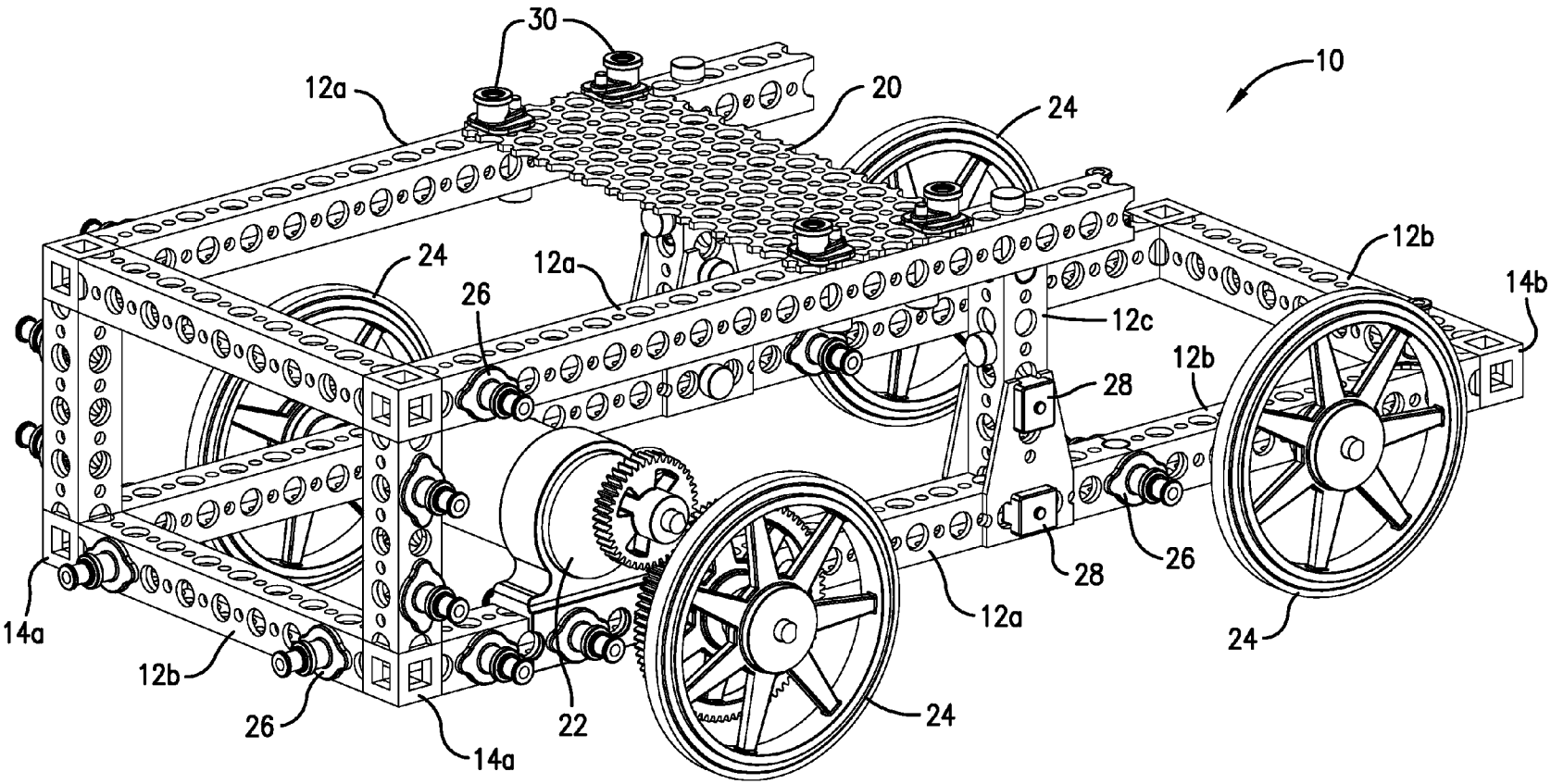
FIG. 1 is a perspective view of a building system designed in accordance with an embodiment of the invention and including various parts assembled to form an exemplary structure.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
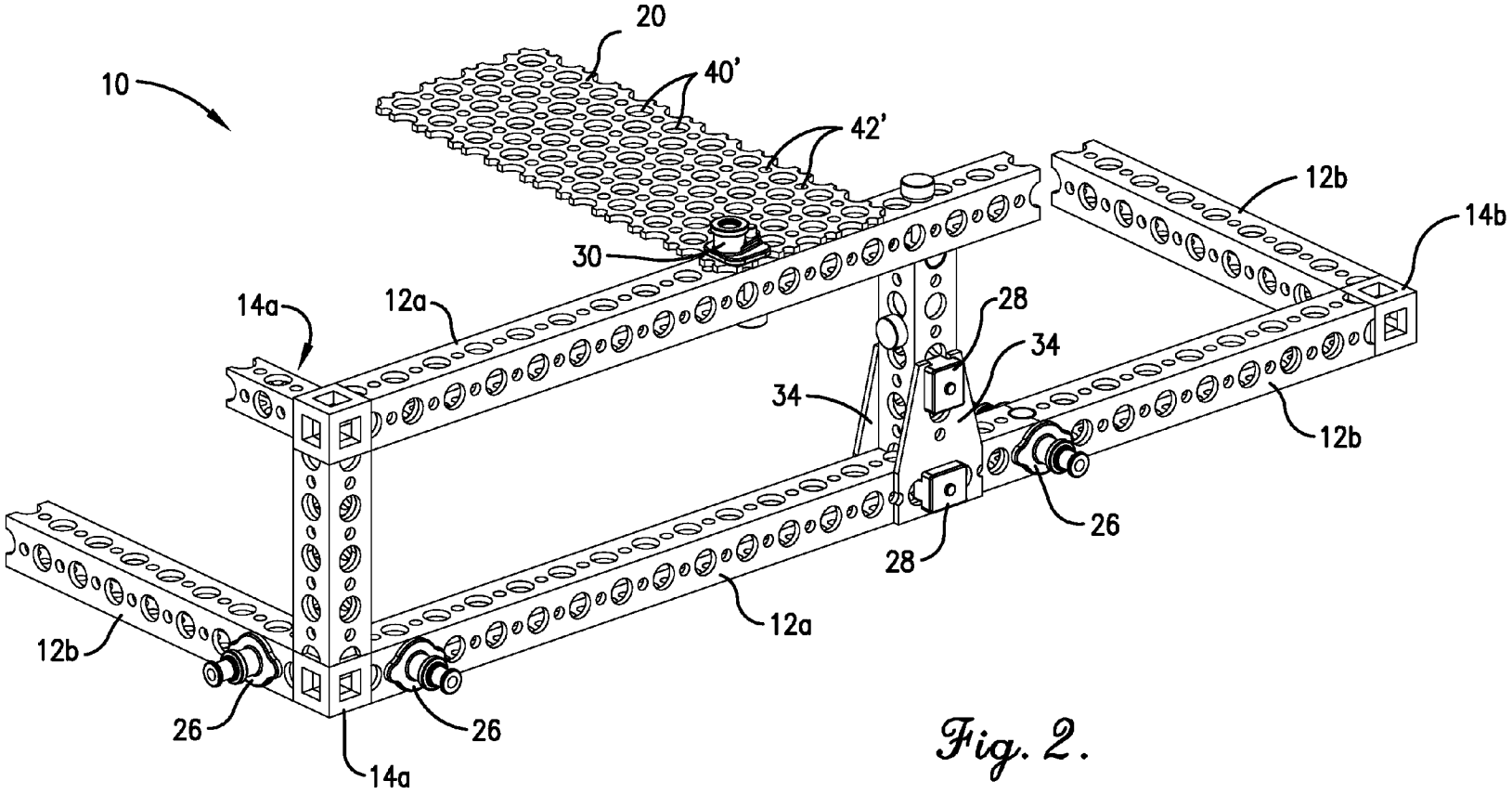
FIG. 2 is a perspective view of a portion of the structure of FIG. 1.
Figure 3:
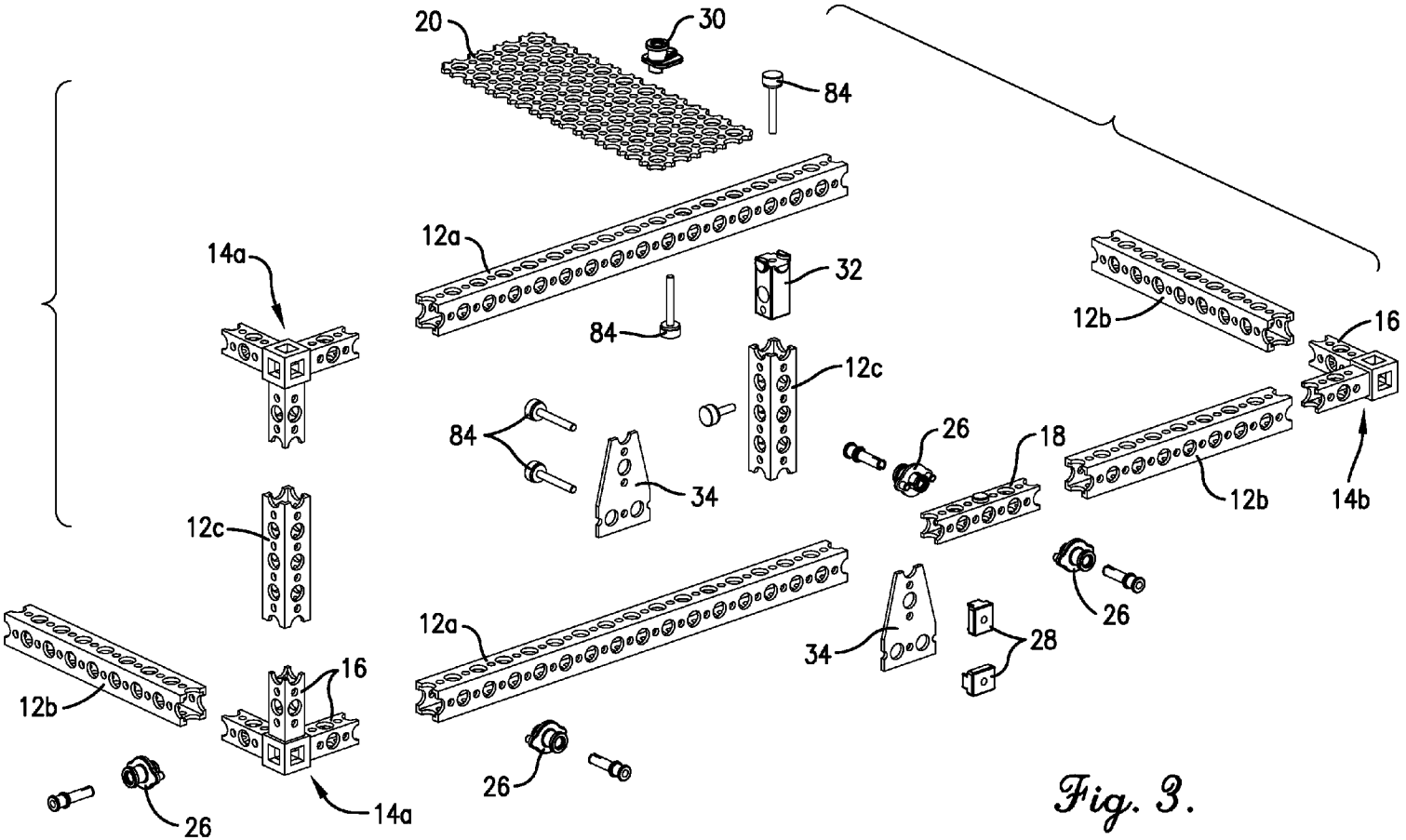
FIG. 3 is an exploded view of the structure of FIG. 2.

Turning now to the drawing figures, and initially FIGS. 1-3, a building system 10 designed in accordance with embodiments of the invention is illustrated. The system 10 comprises a plurality of different parts that may be interconnected to create virtually any number of different structures. The system 10 is particularly configured such that parts form strong and resilient connections when assembled yet may be quickly and easily connected and disconnected such that users, including children, can easily build, modify and disassemble structures using the system 10 without requiring the use of tools. Thus, the system 10 may be, for example, a toy or model construction set used for entertainment, education, and/or research and development purposes.

The building system 10 includes various types of parts including, for example, beams 12 of various lengths, corner connectors 14 each with two or more legs 16 that mate with and interconnect the beams 12, a linear connector 18 used in joining the ends of two beams 12 in a linear configuration, a wall section 20, a motor 22, a plurality of wheels 24, and various connectors 26, 28, 30, 34. Thus, the building system 10 comprises structural parts used primarily to define structure, connectors used primarily to interconnect and secure the structural parts, and parts whose primary purpose is to induce or facilitate motion, such as motors and wheels. It will be understood, however, that some parts may serve more than one purpose and that reference herein to a part as a structural part or a connector should not be taken in a limiting sense.

The particular size and shape of the various parts of the system 10 may vary from one embodiment of the invention to another without departing from the spirit or scope of the invention. Therefore, while dimensions, proportions and other physical characteristics of various parts are set forth herein, it will be understood that such information is provided by way of example and does not limit the scope of the invention.

Figure 4:
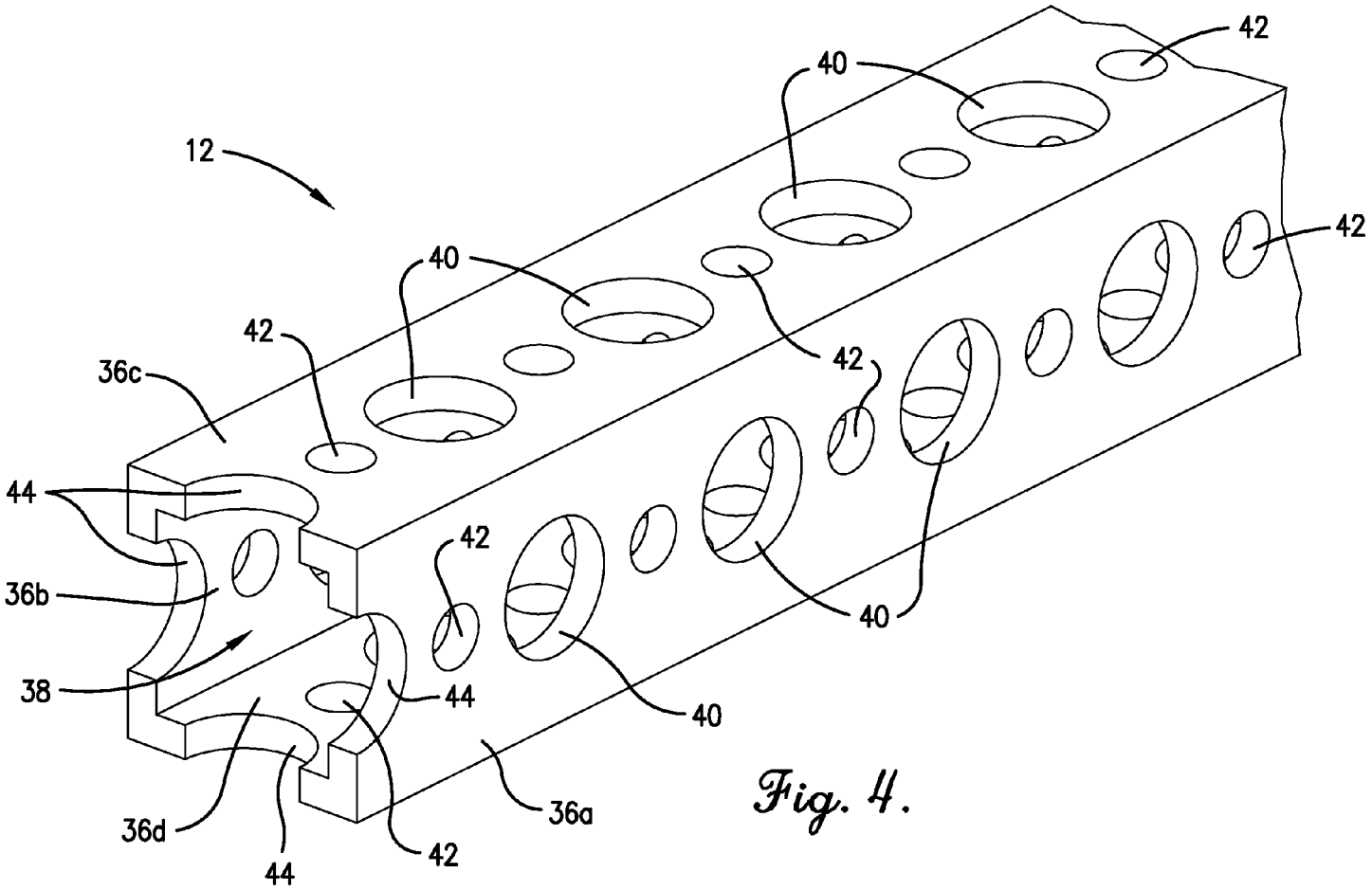
FIG. 4 is an enlarged perspective view of a portion of a beam of the building system of FIG. 1.
Figure 5:
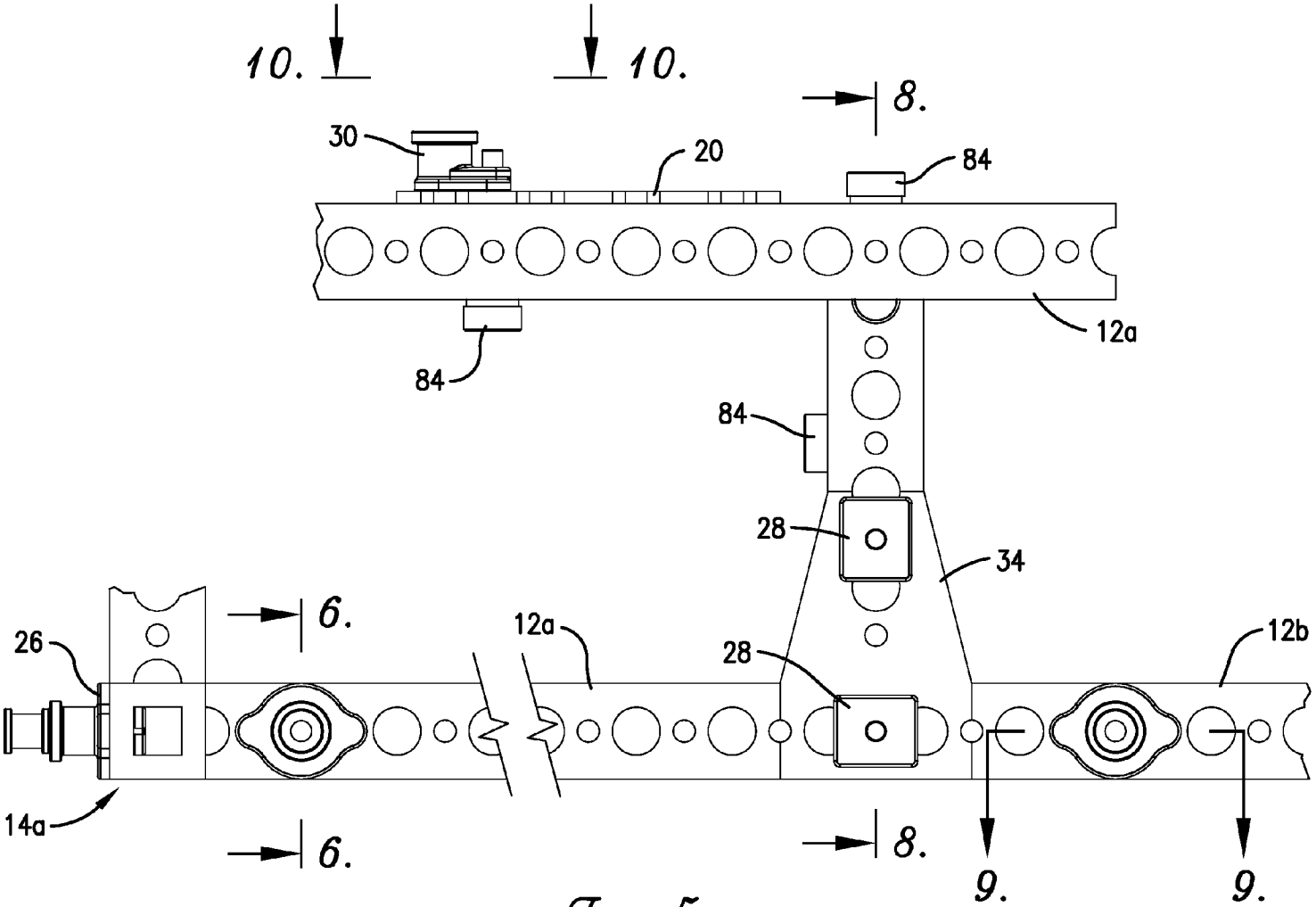
FIG. 5 is a fragmentary side elevation view of a portion of the structure of FIG. 1.

The beams 12 are one of the primary structural parts of the building system 10 and may be provided in various lengths, as illustrated by the exemplary beam sections 12*a*, 12*b* and 12*c* each presenting a different length. With particular reference to FIG. 4, each of the beams 12 comprises a plurality of interconnected outer walls 36 that define an inner channel 38. In one embodiment, each beam 12 includes four outer walls 36 of uniform width, thickness and configuration that are interconnected to define an inner channel 38 presenting a generally square cross section. Each of the outer walls 36 includes a plurality of large apertures 40 and a plurality of small apertures 42 arranged such that each large aperture 40 is proximate at least one small aperture 42. In some embodiments, all of the large apertures 40 are circular with a first uniform diameter, all of the small apertures 42 are circular with a second uniform diameter, and the apertures 40, 42 are arranged in a linear alternating pattern on each of the walls 36. As used herein, a linear alternating pattern is a pattern wherein the centers of the apertures 40, 42 generally lie along a straight line and each large aperture 40 is followed by a small aperture 42 and vice-versa.

The apertures 40, 42 in each of the walls 36 may be in register with the apertures 40, 42 in the opposing wall 36 of the beam to facilitate connecting the beam with other system parts. By way of example, a fastener, connector or other part may extend through an aperture 40, 42 on a first wall 36*a* of the beam, through the inner channel 38 of the beam 12, and through a corresponding aperture on a second, opposing wall 36*b*. As explained below in greater detail and as illustrated in the drawings, a fastener such as a thumbscrew may be inserted through the small apertures 42 of opposing walls to secure a connector to the beam 12.

Each of the beams 12 may be configured with an end aperture 44 on the end of each beam wall 36. Each end aperture 44 corresponds in size, shape and position to a portion of one of the large apertures 40, such as, for example, one-half or one-third of a large aperture 40. In some embodiments, the end apertures 44 present a semicircular shape defined by a radius that is identical to the radius of the large apertures 40.

Each of the outer walls 36 may be between about 8 mm and about 25 mm wide, more preferably between about 12 mm and about 20 mm wide, and may particularly be about 14 mm, about 16 mm or about 18 mm wide. Each of the large apertures 40 may be between about 4 mm and about 12 mm in diameter and may particularly be about 6 mm, about 8 mm or about 10 mm in diameter. Each of the small apertures 42 may be between about 1 mm and about 6 mm in diameter, and may particularly be about 2 mm, about 3 mm, about 3.5 mm, about 4 mm or about 5 mm in diameter. The separation distance between the apertures 40, 42 (the distance from the center of one aperture to the center of the next aperture) may be uniform and may be between about 4 mm and about 12 mm, and may particularly be about 6 mm, about 8 mm or about 10 mm. The ratio of the width of each of the outer walls 36 to the diameter of the large apertures 40 may be between about 1.2 and about 3.5, more preferably between about 1.5 and 2.5, and may particularly be about 1.8, about 2.0 or about 2.2. The ratio of the diameter of the large apertures 40 to the diameter of the small apertures 42 may be between about 1.5 and about 4.0, more preferably between about 2.0 and 3.0, and may particularly be about 2.25, about 2.5 or about 2.75. Each of the walls 36 may be between about 0.5 mm thick and about 3.0 mm thick, and may particularly be about 1.0 mm, about 1.5 mm or about 2.0 mm thick.

In one exemplary embodiment, each of the outer walls 36 is 16 mm wide and 1.5 mm thick; each of the large apertures 40 is 8 mm in diameter; each of the small apertures 42 is 3.7 mm in diameter; each of the end apertures 44 presents a semicircular shape corresponding in size and configuration to one-half of one of the large apertures 40; and the separation distance between the apertures 40, 42 is 8 mm.

Figure 13:
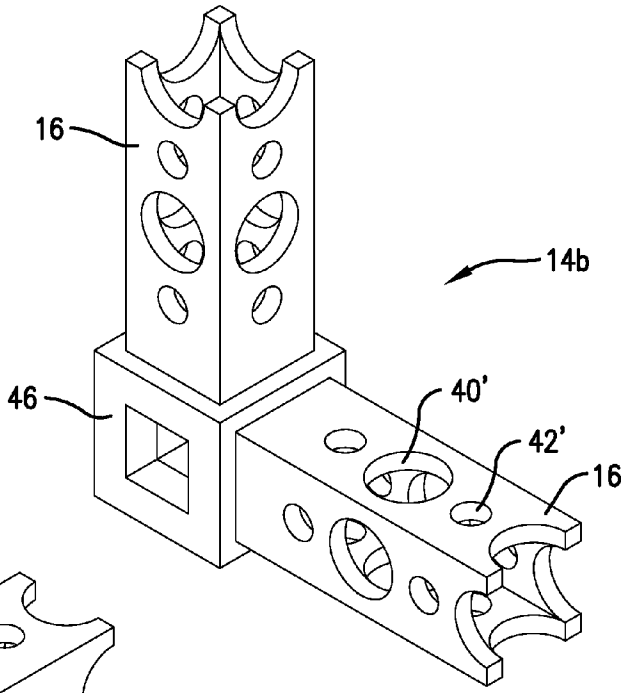
FIG. 13 is a perspective view of a second corner connector of the building system of FIG. 1.
Figure 12:
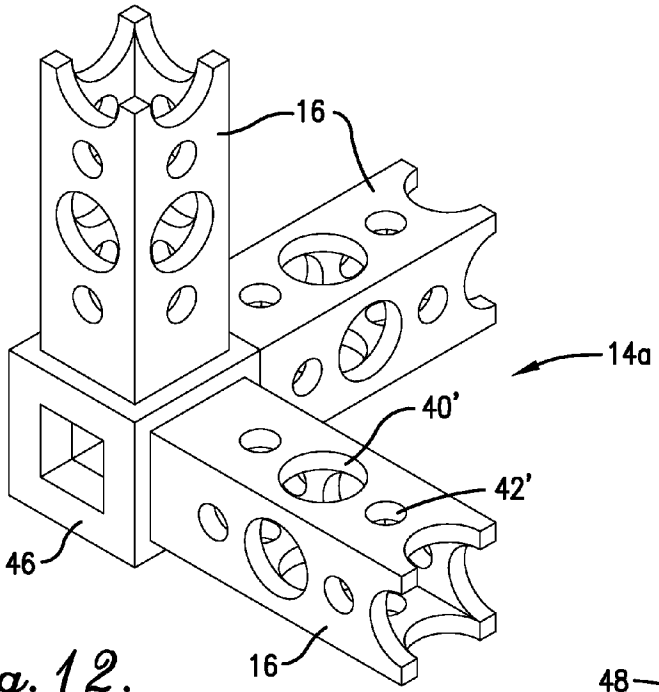
FIG. 12 is a perspective view of a first corner connector of the building system of FIG. 1.

Each of the corner connectors 14 is configured to interconnect and support two or more beams 12. With particular reference to FIGS. 12 and 13, each of the corner connectors 14 includes a cube-shaped base 46 with square faces that are similar or identical in width to the outer walls 36 of the beams 12 such that, when assembled, outer surfaces of the base 46 are more or less flush with outer surfaces of the beams 12 (see, e.g., FIGS. 1 and 2). Each of the corner connectors 14 includes two or more legs 16 each configured to slidingly engage the inner channel 38 of one of the beams 12. In some embodiments, each leg 16 is separated from each of the other legs 16 by an angle of 90°.

Each of the connector legs 16 may comprise four outer walls similar to the outer walls 36 of the beams 12 but with a smaller profile. The outer dimensions of each of the legs 16 are preferably equal to or slightly less than corresponding dimensions of the inner channel 38 such that when the system 10 is assembled each leg 16 is fittingly positioned within one of the channels 38 to minimize shifting of the corner connectors 14 within the beams 12. As used herein, a corner connector leg 16 or other component is "fittingly positioned" within a channel 38 if the outer profile of the leg 16 or component is approximately the same size as, or slightly smaller than, the channel profile such that the leg 16 or component fits snugly within the channel 38 or experiences minimal lateral movement within the channel 38. Such a configuration adds strength and rigidity to the connection and the overall structure. By way of example, if each of the beam walls 36 is 1.5 mm thick, the width of each of the walls of the corner connector legs 16 may be about 3.0 mm less than the width of the beam walls 36.

The corner connector leg walls include large and small apertures 40', 42' that are similar or identical in size, shape and placement to the large and small apertures 40, 42 of the beam walls 36 such that when a connector leg 16 is fully inserted into a beam 12, the apertures 40', 42' align with the beam apertures 40, 42 and are thus positioned to receive connectors that fixedly secure the corner connector 14 to the beams 12.

The wall section 20 is a rigid structural part that defines a plurality of large and small apertures 40', 42' that may be similar or identical in size, shape and placement pattern to the large and small apertures 40, 42. In some embodiments, the apertures 40', 42' of the wall section 20 form an alternating array pattern wherein each row and column of the array presents an alternating linear pattern of apertures 40', 42' that is identical to the alternating linear pattern of apertures 40, 42 on the beam walls 36. The wall section 20 may be about 1.0 mm, about 1.5 mm or about 2.0 mm thick with an outer perimeter of virtually any size and shape. The illustrated wall section 20 presents an outer perimeter with a rectangular shape that is about 4.75 cm wide and about 9.5 cm long. In some embodiments, the wall section 20 is the same thickness as the walls 36 of the beams 12 and the walls of the legs 16 of the corner connectors 14.

Figure 9:
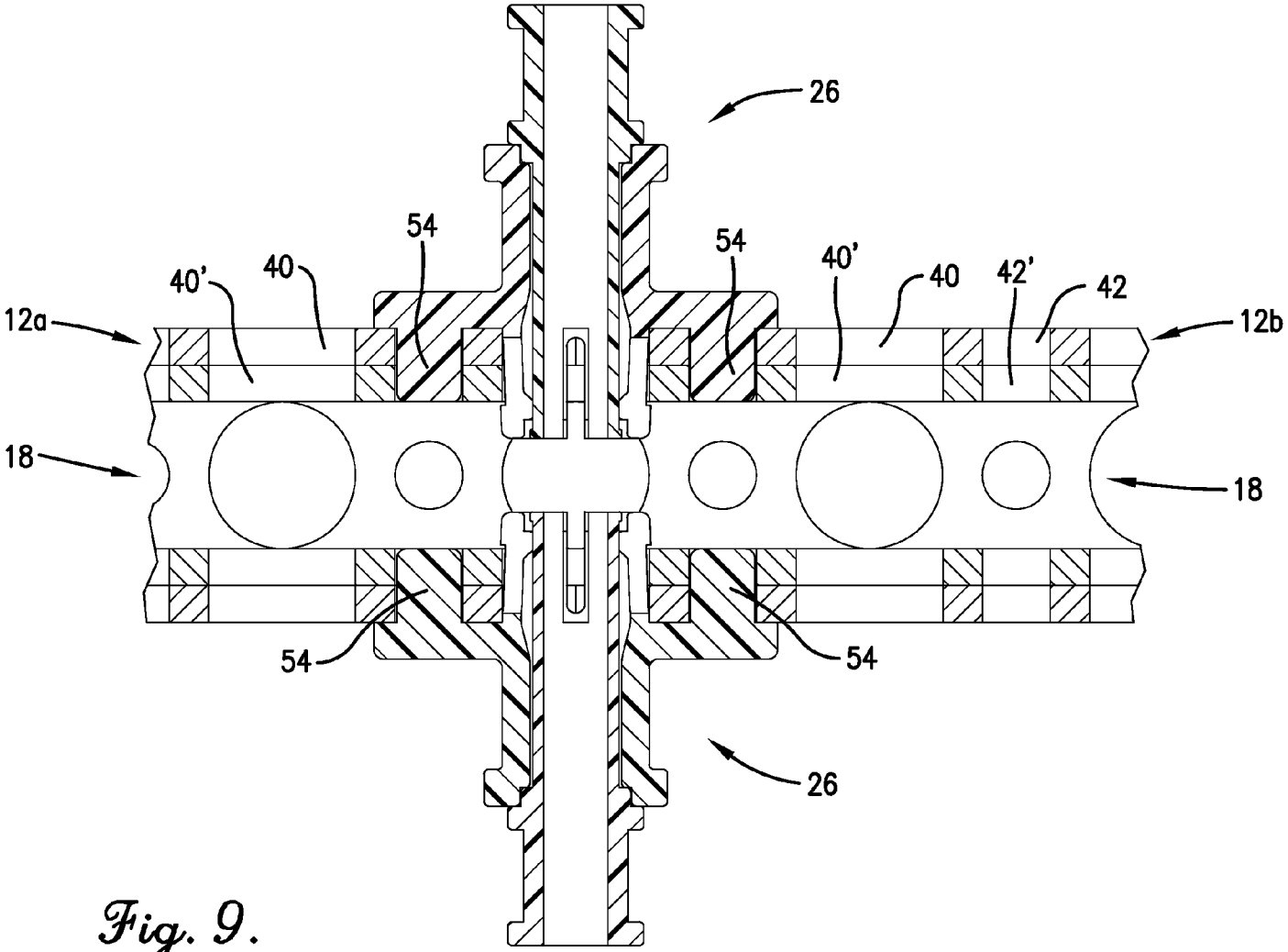
FIG. 9 is a cross-sectional fragmentary view of various parts of the structure of FIG. 1 taken along line 9-9 of FIG. 5.
Figure 14:
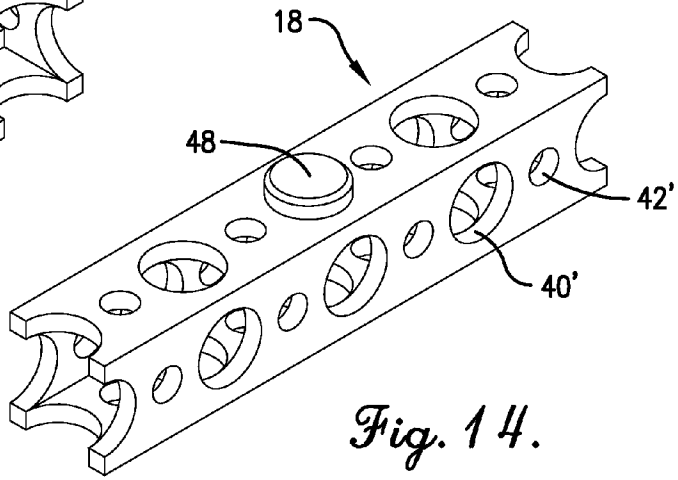
FIG. 14 is a perspective view of a linear connector of the building system of FIG. 1.

The linear connector 18, most clearly illustrated in FIGS. 3, 9 and 14, provides internal structural support to a joint formed by two beams placed in-line and end-to-end, such as the beams 12*a* and 12*b* in FIG. 1. More particularly, the linear connector 18 is configured to engage the inner channels 38 of two beams 12 so joined and hold the beams in a straight configuration such that the adjoined beams function as a single, rigid unit. Thus, as with the connector legs 16 of the corner connectors 14, an outer profile of the linear connector 18 corresponds in size and shape to the inner channels 38 of the beams 12 such that the linear connector 18 is fittingly positioned within the channels 38 when assembled.

The linear connector 18 includes a plurality of walls that may be similar in size, shape and configuration to the walls of the corner connector legs 16. In the illustrated embodiment, the linear connector 18 includes four walls each including a plurality of large and small apertures 40', 42' similar or identical in size, shape and placement to the large and small apertures 40, 42 of the beams 12. The number of apertures 40', 42' depends, in part, on the overall length of the linear connector 18 but each of the walls may include three large apertures 40', four small apertures 42' and an end aperture on the end of each wall similar or identical to the end apertures 44 described above. The linear connector 18 also includes at least one protrusion 48 extending outwardly from one of the walls and configured to engage one of the end apertures 44 of the adjoined beams 12 to secure the linear connector 18 in place relative to the adjoined beams 12. In one embodiment, a single protrusion 48 is placed at a center of the linear connector 18 and corresponds in placement and shape to the end apertures 44 of the beams 12, such that end apertures 44 of the adjoined beams engages opposite sides of the protrusion 48.

To adjoin a pair of beams 12 using the linear connector 18, a first beam 12 is slid over a first end of the linear connector 18 until an end aperture 44 of the beam 12 engages a first side of the protrusion 48 and a second beam 12 is slid over a second end of the linear connector 18 until an end aperture 44 of the beam 12 engages a second side of the protrusion 48. With the beams 12 so assembled, the large 40 and small 42 apertures of the beam walls 36 align with the large 40' and small 42' apertures of the linear connector. A pair of expansion connectors 26 may be attached to opposing sides of the joint created by the beams 12 and the linear connector 18 to fixedly secure the beams 12 to the linear connector 18, as illustrated in FIG. 9. The form and function of the expansion connectors 26 are described in greater detail below.

It should be noted that, in some embodiments, the size, shape and placement pattern of the large and small apertures are uniform across the various parts including the beams 12, corner connectors 14, the linear connector 18 and the wall section 20. Thus, these parts can be interconnected in virtually any configuration using the various connectors, as explained below.

The building system 10 includes various connectors including expansion connectors 26, thumbscrew connectors 28, 30, 32 and plate connectors 34. Each of the expansion connectors 26 engages a large aperture 40 of one of the system parts described above (or engages the large apertures 40 of multiple parts simultaneously) and expands to lock into place. More specifically, and with particular reference to FIGS. 6-7 and 15-18, the expansion connector 26 includes a base 50, an expansion element 52 and a pair of alignment posts 54 extending from a first side of the base 50, and a receptacle 56 extending from a second side of the base 50. An aperture 60 in the base is in register with the expansion element 52 and the receptacle 56 such that the expansion element 52 and the receptacle 56 cooperatively define a central through-hole 62. The expansion connector 26 also includes a pin 58 configured to slidingly engage the through-hole 62 and force the expansion element 52 into locking engagement with the one or more large apertures in which the expansion element 52 is seated.

The expansion element 52 presents a generally cylindrical shape in circumscribing relationship to the aperture 60. The expansion element 52 includes a plurality of flexible sections 64 configured to flex inwardly (toward a center of the expansion element 52) and outwardly (away from the center of the expansion element 52) during use to facilitate engagement of the connector 26 with another part and to lock the connector 26 into engagement with that part.

Figure 6:
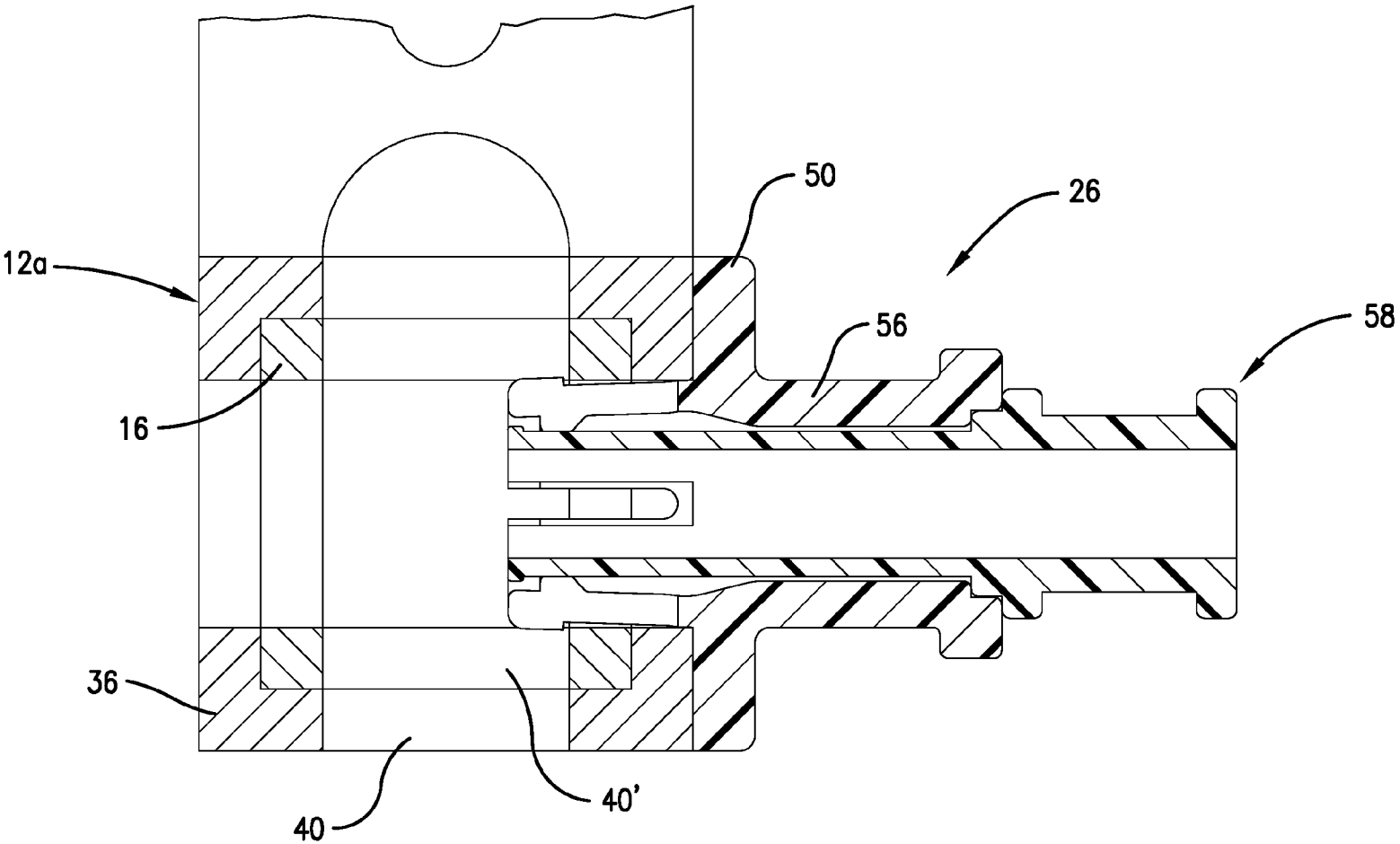
FIG. 6 is a cross-sectional fragmentary view of various parts of the structure of FIG. 1 taken along line 6-6 of FIG. 5 and illustrating an expansion connector with a pin in a seated, locked position.
Figure 7:
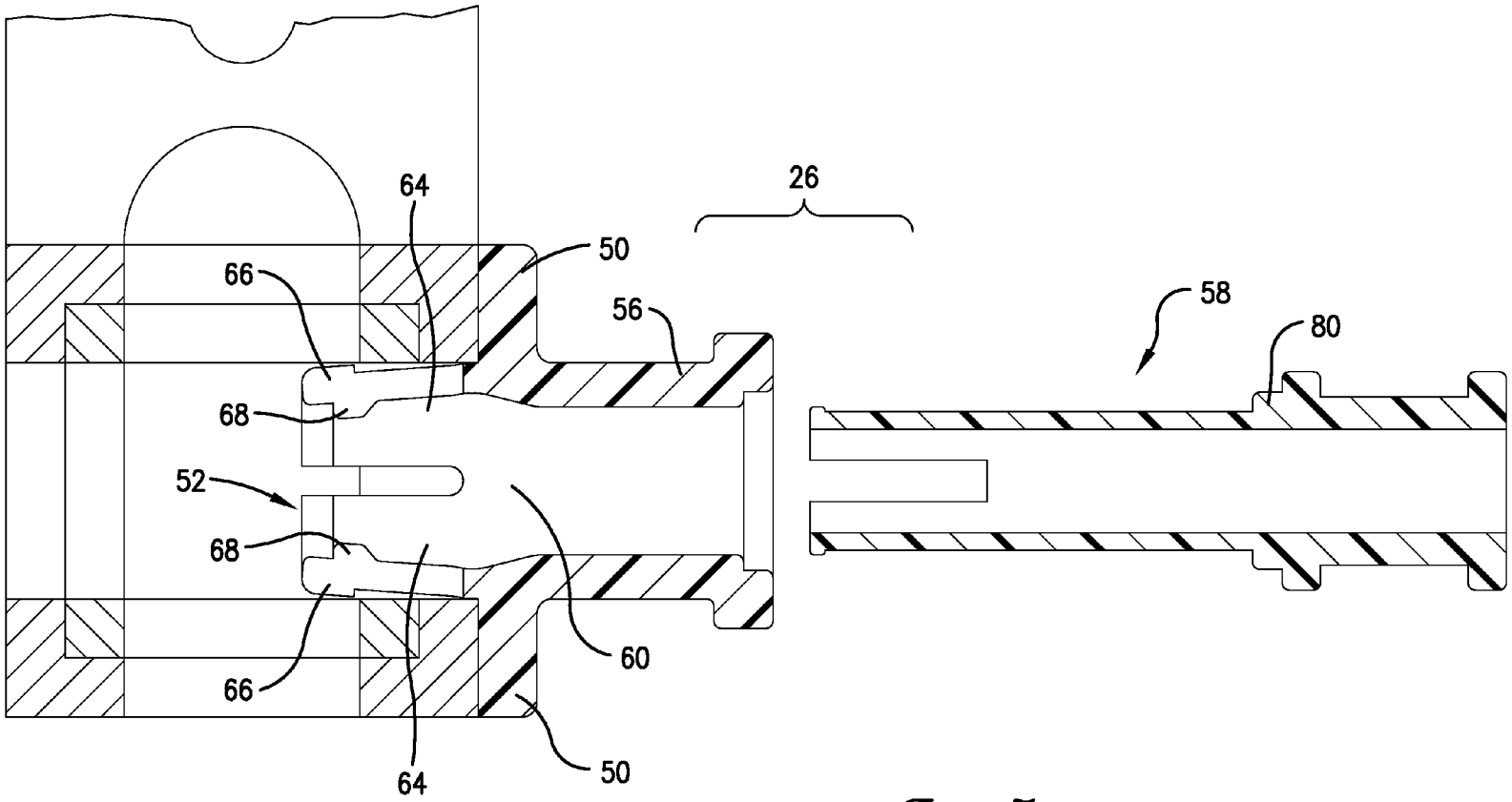
FIG. 7 is the cross-sectional fragmentary view of FIG. 6 illustrating the pin in a separated, unlocked position.

Each flexible section 64 includes an outer lip 66 extending radially outwardly and an inner lip 68 extending radially inwardly. Both the inner lip 68 and the outer lip 66 are positioned on portions of the flexible sections 64 distal the base 50 such that when the expansion element 52 is inserted through a large aperture of one of the system parts, or through two large apertures positioned in a stacked relationship (e.g., as illustrated in FIGS. 6 and 7), the outer lip 66 is positioned on an opposite side of the wall (or walls) from the base 50 and serves as a detent, preventing the connector 26 from sliding through the aperture or apertures.

As illustrated in FIG. 9, the alignment posts 54 are configured and positioned to engage one or more small apertures 42, 42' when the expansion connector 26 is coupled with one or more of the system parts, thereby providing structural rigidity and preventing the expansion connector 26 from shifting when locked into engagement with the system parts. More specifically, when the expansion element 52 engages the large apertures 40, 40' the alignment posts 54 engage small apertures 42, 42 on either side of the large apertures 40, 40'. Thus, the alignment posts 54 preferably present an outer profile corresponding to the size and shape of the small apertures. Furthermore, the expansion element 52 and alignment posts 54 are preferably positioned according to the same pattern as the large and small apertures. In some embodiments, the alignment posts 54 present a cylindrical shape with a diameter approximately the same as, or slightly less than, the diameter of the small apertures 42, 42'. The alignment posts 54 may be long enough to extend through two small apertures 42, 42' positioned in a stacked relationship, as illustrated in FIG. 9. Alternatively, each alignment post 54 may be configured to extend through only a single small aperture, or only through a portion of a small aperture.

Figure 18:
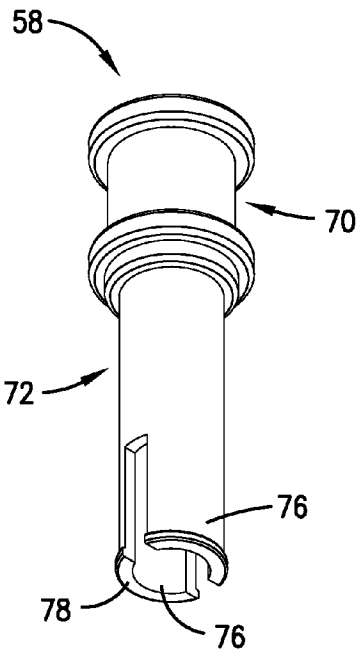
FIG. 18 is a bottom perspective view of the pin of FIG. 17.
Figure 17:
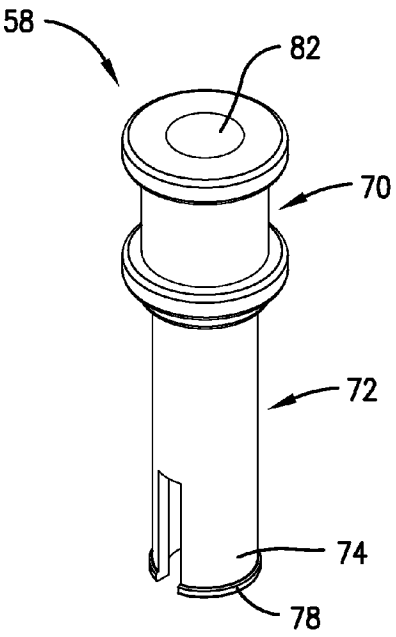
FIG. 17 is a top perspective view of a pin configured for use with the expansion connector of FIG. 15.
Figure 15:
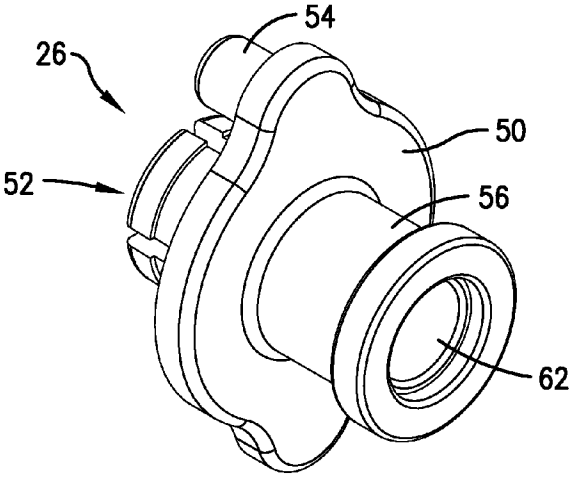
FIG. 15 is a perspective view of a first side of an expansion connector of the building system of FIG. 1.
Figure 16:
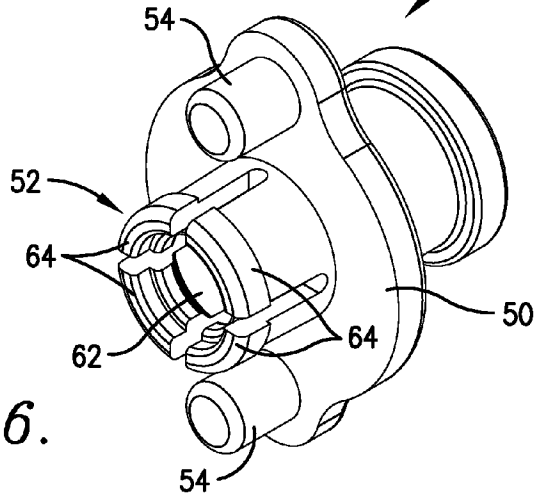
FIG. 16 is a perspective view of a second side of the expansion connector of FIG. 15.

The receptacle 82 of the pin 58, such as depicted in FIGS. 17 and 18, may be between about 5 mm and about 11 mm long, and may particularly be about 7 mm, about 8 mm, or about 9 mm long. The receptacle 82 may be between about 1 mm and about 10 mm in diameter, more preferably between about 3 mm and about 8 mm in diameter, and may particularly be about 4 mm, about 5 mm or about 6 mm in diameter.

The pin 58 includes a head 70 and a shank 72 and is configured to slidingly engage the through-hole 62 such that an end 74 of the shank distal the head 70 is inserted through the receptacle 56 and into engagement with the expansion element 52 where it forces the flexible sections 64 outward. The end 74 of the shank 72 includes a plurality of flexible fingers 76 that engage the flexible sections 64 of the expansion element 52. A lip 78 positioned at or near the end of the shank 72 extends outwardly from each of the flexible fingers 76. When the pin 58 engages the expansion element 52, the fingers 76 flex inwardly while the flexible sections 64 of the expansion element 52 flex outwardly. This not only urges the flexible sections 64 into engagement with the apertures in which the connector 26 is seated, but also secures the pin 58 in place via a friction fit. When the expansion element 52 is so engaged, outer surfaces of the expansion element 52 engage inner surfaces of the apertures 40, 40', the base 50 is on a first side of the walls defining the apertures, and the outer lips 66 are on a second side of the walls defining the apertures, as illustrated in FIG. 6. Thus, the base 50 and the outer lips 66 prevent the expansion element 52 from shifting longitudinally relative to the walls, securing the expansion connector 26 and the parts in fixed relationship until a user removes the pin 58.

The head 70 includes an annular shoulder 80 that engages a corresponding annular recess in the receptacle 56 when the pin 58 is fully seated. The head 70 may include a receptacle 82 for receiving another part (not shown), including parts associated with a separate building system. The overall length of the pin 58 may be between about 1 cm and about 4 cm, more preferably between about 1.5 cm and about 3 cm, and may particularly be about 2 cm, about 2.25 cm or about 2.5 cm. The head 70 may be between about 3 mm and about 1.5 cm long, more preferably between about 5 mm and 1.3 cm long, and may particularly be about 7 mm, about 8 mm or about 9 mm long. The shank 72 may be between about 1 cm and about 2 cm long and may particularly be about 1.3 cm, about 1.5 cm or about 1.6 cm long. An outer diameter of the shank 72 corresponds to an inner diameter of at least a portion of the through-hole 62, and may be between about 2 mm and about 8 mm, and may particularly be about 4 mm, about 5 mm or about 6 mm.

The expansion element 52 presents an outer diameter that is approximately equal to, or slightly less than, the diameter of the large apertures 40 such that when the expansion connector 26 is connected to another part, outer surfaces of the expansion element 52 contact inner surfaces of the large aperture of the part, as illustrated in FIG. 6. In some embodiments, the distance between the base 50 and the outer lips 66 is approximately equal to, or slightly larger than, twice the thickness of the walls of the parts thereby allowing the expansion connector 26 to connect to two walls positioned in a stacked relationship as illustrated in FIGS. 6 and 7. Thus, if each of the walls is 1.5 mm thick, for example, the distance between the base 50 and the outer lips 66 may be about 3 mm or slightly more than 3 mm.

The expansion connector 26 may be used to secure a first part to a second part that is nested in or adjacent to the first part. As illustrated in FIG. 1, for example, the expansion connector 26 may be used to secure a beam 12 to a leg 16 of one of the corner connectors 14, may be used to secure adjoining beams 12 to the linear connector 18 (see also FIG. 9), or may be used to secure the motor 22 or other part to one of the beams 12. These are but a few examples. The expansion connector 26 is particularly adapted to engage and connect adjoining large apertures of part walls located in an adjacent or "stacked" relationship, such as the walls illustrated in FIGS. 6 and 7 and as explained above.

With particular reference to FIGS. 6 and 7, to secure an expansion connector 26 to two parts arranged in a stacked relationship, the pin 58 is removed from the connector 26 and the expansion element 52 is inserted into and through the large apertures 40, 40' of the one or more parts until the base 50 is adjacent an outer surface of the part. As the expansion element 52 passes through the apertures 40, 40', the flexible sections 64 deflect inward as the outer lips 66 engage inner surfaces of the apertures 40, 40' and apply inward pressure on the flexible sections 64. When the connector 26 is fully inserted through the apertures 40, 40', the outer lips 66 are positioned on a side of the part walls opposite the base 50 and no longer engage the inner surfaces of the apertures 40, 40', thus allowing the flexible sections 64 to return to a more relaxed position wherein outer surfaces of the sections 64 engage inner surfaces of the apertures 40, 40' and the outer lips 66 engage a rim of the innermost aperture 40'.

When the expansion connector 26 is fully inserted into the apertures 40, 40', the pin 58 is inserted through the receptacle 56 and into engagement with the expansion element 52 to lock the connector 26 into position and secure the parts to the connector 26. More particularly, a user may grasp the head 70 of the pin 58 and insert the shank 72 through the receptacle 56 and into engagement with the expansion element 52. As the shank 72 enters the expansion element 52 and engages the inner lips 68 of the flexible sections 64, the flexible fingers 76 of the pin 58 deflect inwardly. When the pin 58 is fully seated in the connector 26 the flexible fingers 76 engage the inner lips 68 in a friction fit and apply outward pressure on the lips 68, urging the flexible sections 64 into engagement with the inner surfaces of the apertures 40, 40'. If the pin 58 begins to slide out of the expansion connector 26, the lip 78 on the end of the shank 72 of the pin 58 engages the inner lips 68 and resists movement. Thus, the pin 58 remains seated in the connector 26 until a user removes the pin 58.

The thumbscrew connectors 28, 30, 32, as most clearly depicted in FIGS. 8, 10-11 and 19-22, are configured to interconnect two or more system parts by engaging one or more of the large apertures 40, 40' and receiving a thumbscrew 84 which secures the connector to the part. The thumbscrews 84 and the connectors 28, 30, 32 are configured to be easily coupled with and removed from system parts. The thumbscrews 84, for example, include relatively large heads with knurled outer surfaces to facilitate gripping and turning the heads. The thumbscrew heads may be between about 5 mm and about 15 mm in diameter, and may particularly be about 8 mm, about 10 mm or about 12 mm in diameter. The thumbscrew heads may be between about 1 mm and 10 mm in height, and may particularly be about 3 mm, about 5 mm or about 7 mm in height. The thumbscrew shanks are partially or completely threaded and small enough to pass through the small apertures 42, 42' of the system parts described above. The system 10 may include different types of thumbscrews with shanks of different lengths, but at least some of the thumbscrews 84 are long enough that the shanks can pass through the inner channel 38 of the beams 12 and engage parts on a sides of the beam 12 opposite the thumbscrew head. In one embodiment of the system 10, the thumbscrews 84 are number six screws with shanks that are both 25 mm and 12 mm in length.

Figure 19:
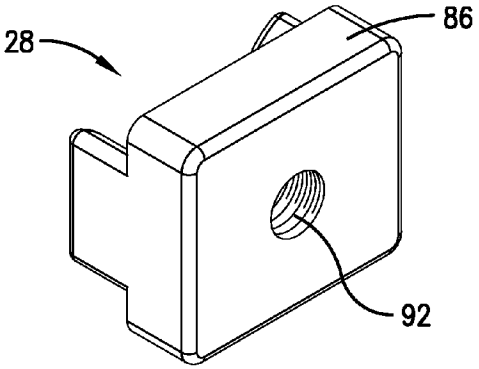
FIG. 19 is a perspective view of a first side of a thumbscrew connector for use with the building system of FIG. 1.
Figure 20:
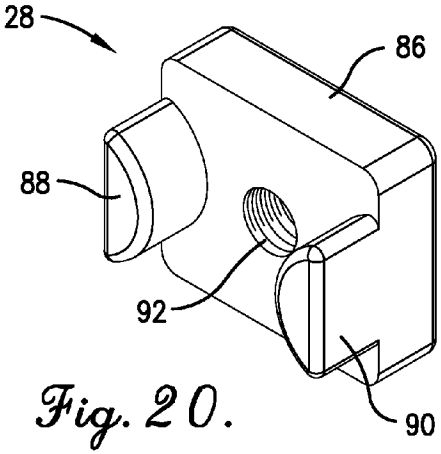
FIG. 20 is a perspective view of a second side of the thumbscrew connector of FIG. 9.

A first type of thumbscrew connector 28, most clearly illustrated in FIGS. 19 and 20, includes a base 86 and a pair of flanges 88, 90 configured to engage the large apertures 40, 40' of system parts. The connector 28 also includes a threaded receptacle 92 in the base 86 for receiving and securing the threaded shank of a thumbscrew 84. The flanges 88, 90 and the receptacle 92 are positioned such that when the flanges 88, 90 each engage a large aperture 40, 40' of one of the system parts, the threaded receptacle 92 is aligned with a small aperture to allow a thumbscrew 84 to be inserted through the small aperture and into engagement with the threaded receptacle 92, thereby securing the connector 28 to the part. In the illustrated embodiment, each of the flanges 88, 90 presents a flat outer side and an arcuate inner side, with each of the arcuate inner sides configured to matingly engage a portion of an inner surface of a large aperture 40, 40'.

Figure 8:
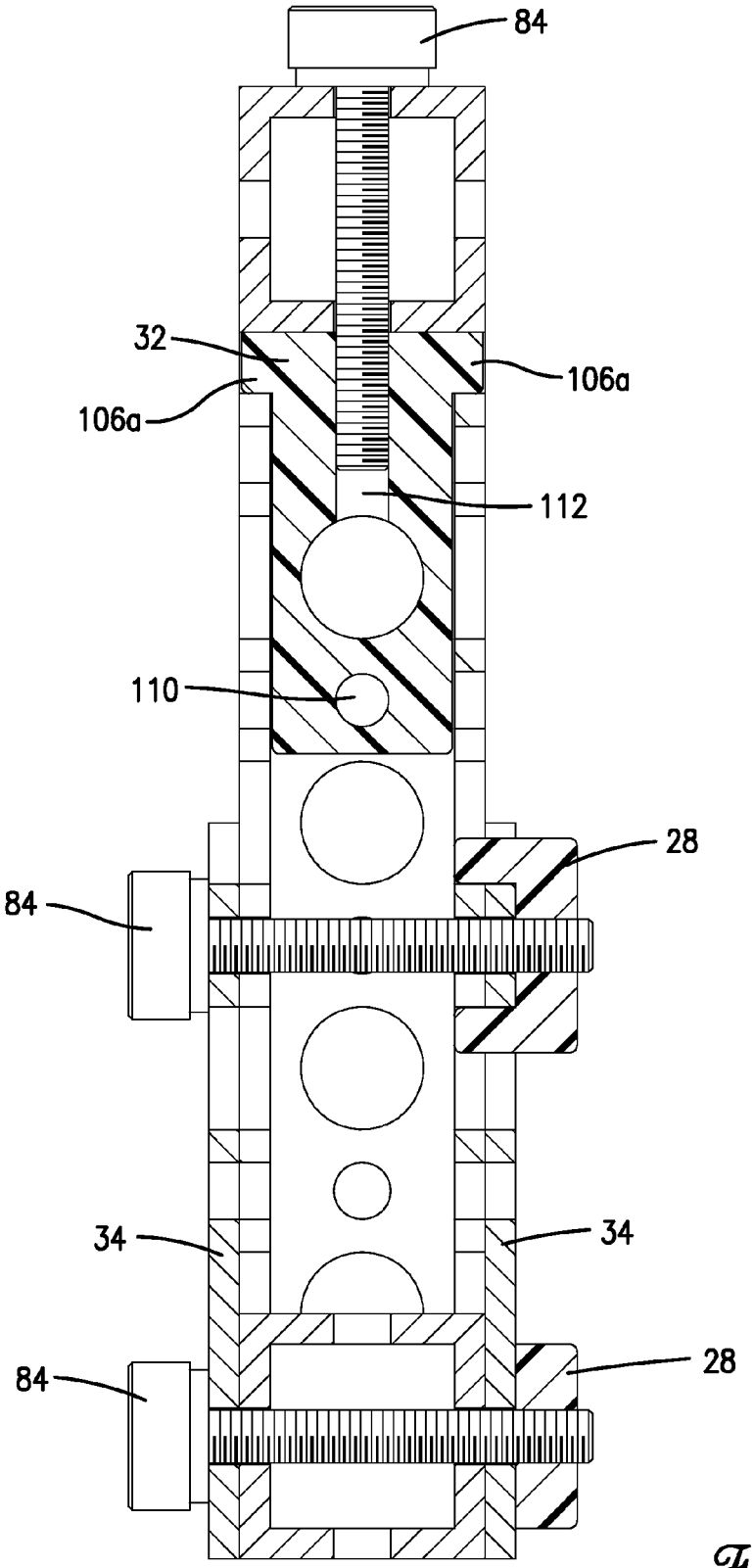
FIG. 8 is a cross-sectional view of various parts of the structure of FIG. 1 taken along line 8-8 of FIG. 5.

The height of the flanges 88, 90 may correspond to approximately twice the thickness of the walls of the parts such that each flanges 88, 90 may simultaneously engage two large adjacent apertures, as illustrated in FIG. 8. This configuration allows the connector 28 to simultaneously engage the walls of two different parts that are positioned in a stacked relationship and thus secure the parts in a fixed relationship one to the other. By way of example and as illustrated in FIGS. 1, 2 and 8, the first type of thumbscrew connector 28 may be used to secure a plate connector 34 to one or more beams 12.

Figure 10:
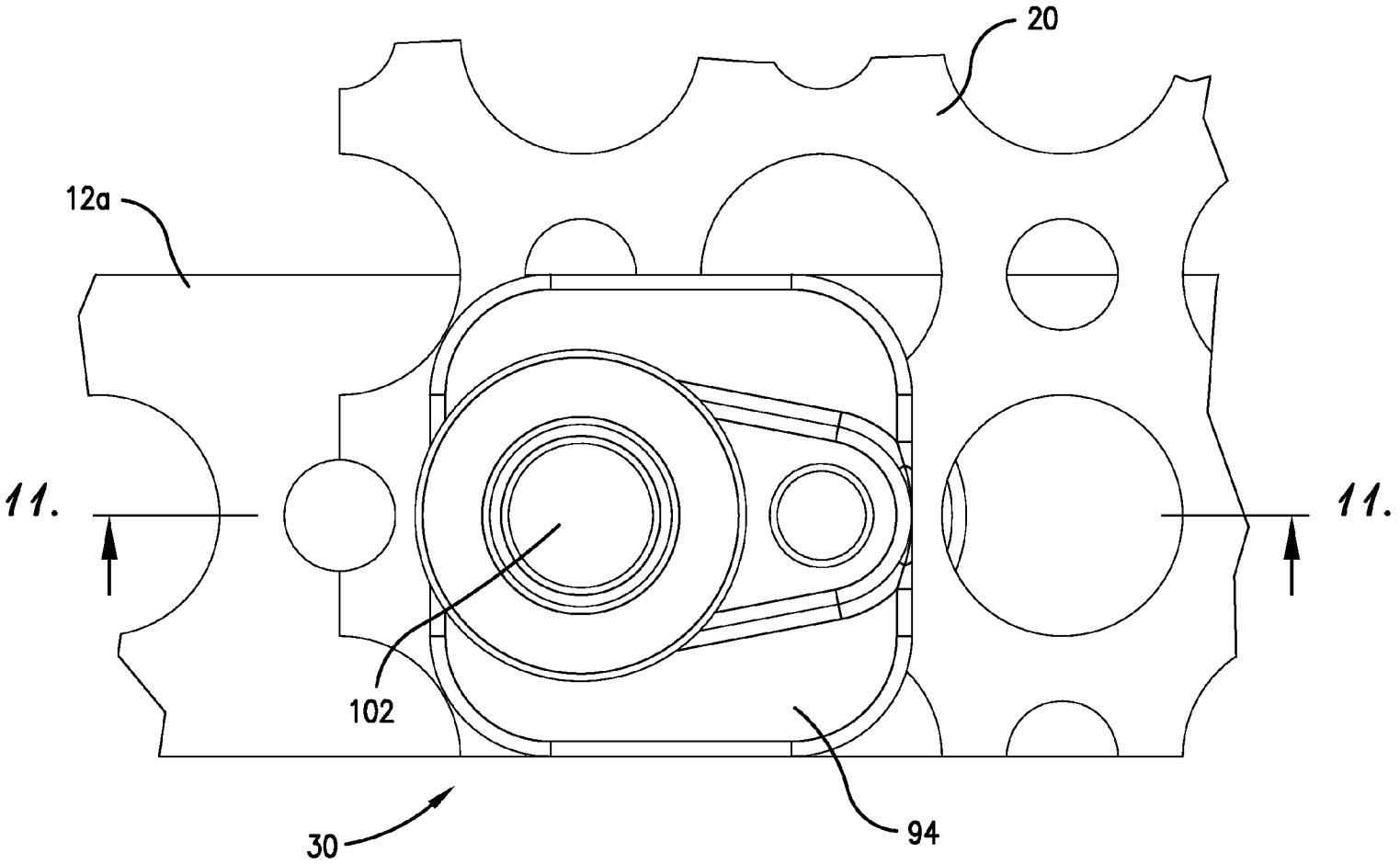
FIG. 10 is a fragmentary plan view of various parts of the structure of FIG. 1 taken along line 10-10 of FIG. 5.
Figure 11:
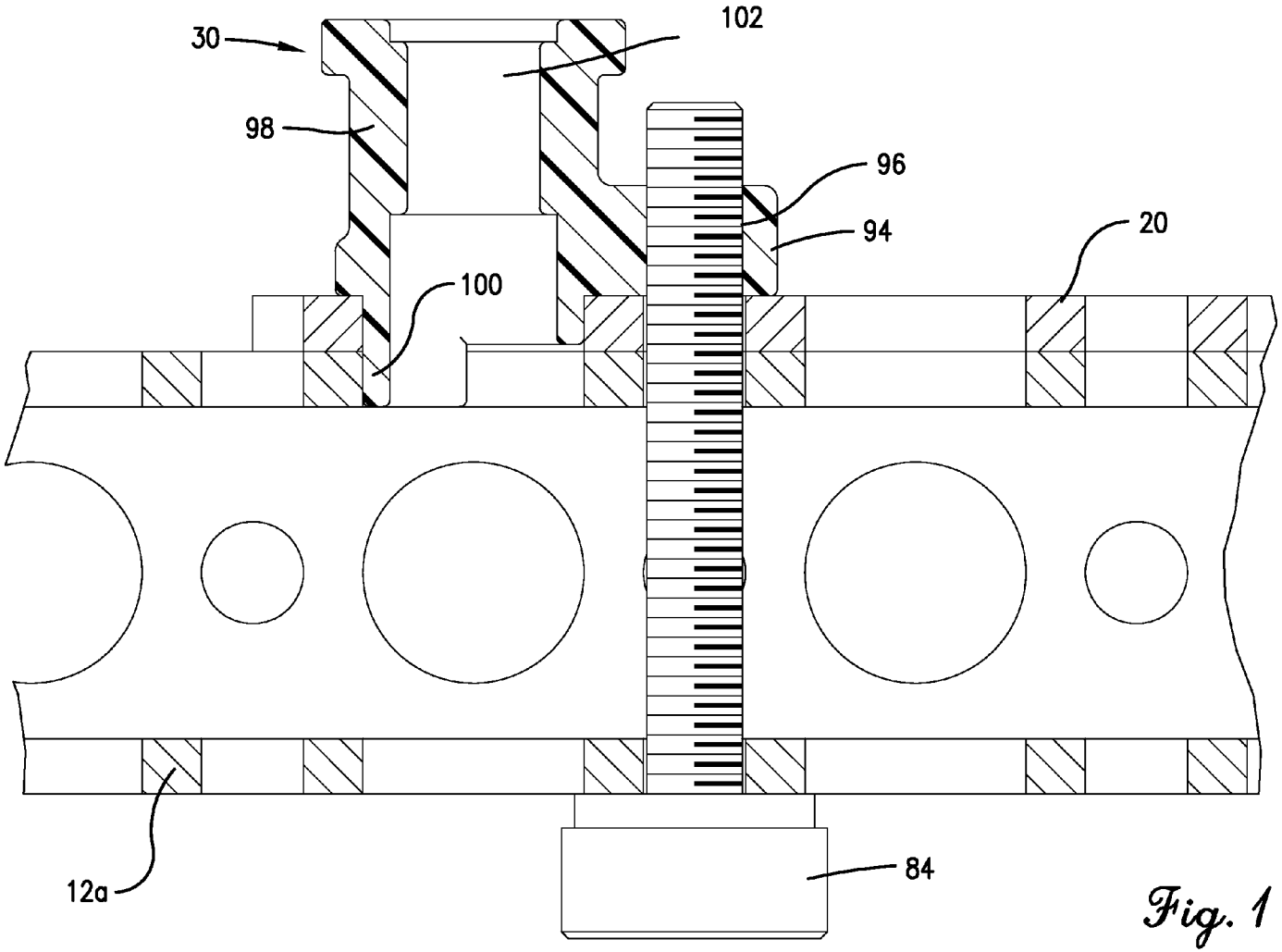
FIG. 11 is a cross-sectional fragmentary view of various parts of the structure of FIG. 1 taken along line 11-11 of FIG. 10.

The second type of thumbscrew connector 30, most clearly illustrated in FIGS. 10 and 11, includes a base 94, a threaded receptacle 96 in the base for receiving a threaded shank of a thumbscrew 84, a large receptacle 98, and a flange 100. The large receptacle 98 extends from a first side of the base 94 and defines a through-hole 102 that may be used, for example, to engage another part. The flange 100 extends from a second side of the base 94 proximate and at least partially surrounding the through-hole 102, and is configured to engage an inner surface of one of the large apertures 40, 40'. The large receptacle 98 may be positioned immediately opposite the flange 100 such that the large receptacle 98 and the flange 100 cooperatively define the through-hole 102.

The flange 100 and the threaded receptacle 96 are positioned such that when the flange 100 engages one of the large apertures 40, 40', the threaded receptacle 96 is in register with a small aperture 42, 42' to receive a thumbscrew 84 inserted through the small aperture to secure the thumbscrew to the part. In some embodiments, the base 94 presents a square shape that is approximately the same width as the walls 36 of the beams 12 such that when the connector 30 is attached to one of the beams the edges are approximately flush with the walls 36, as illustrated in FIG. 10. In some embodiments, a first portion of the flange 100 extends sufficiently far from the base 94 to engage the apertures 40, 40' of two walls arranged in a stacked relationship and a second portion of the flange 100 extends only far enough to engage a single wall. An example of such an embodiment is illustrated in FIG. 11. The large receptacle 98 may be similar in size and shape to the receptacle 56, described above.

A third type of thumbscrew connector 32 is configured to engage the inner channel 38 of the beams 12. More particularly, the connector 32 is configured to engage the inner channel 38 of a beam 12 and to engage a wall of a second part to connect the beam 12 to the second part. The connector 32 may be used, for example, to connect an end of a beam 12*c* to a side of a beam 12*a*, as illustrated in FIGS. 1, 2 and 8.

Figure 21:
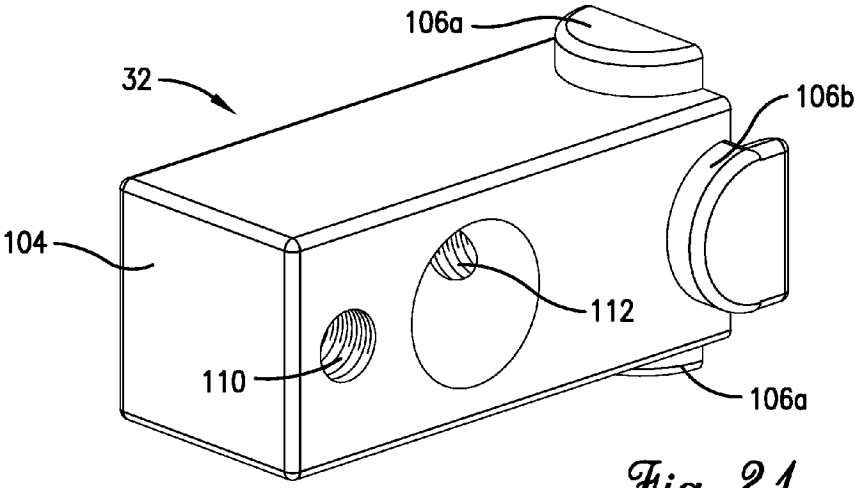
FIG. 21 is a perspective view of a first end of another thumbscrew connector for use with the building system of FIG. 1.
Figure 22:
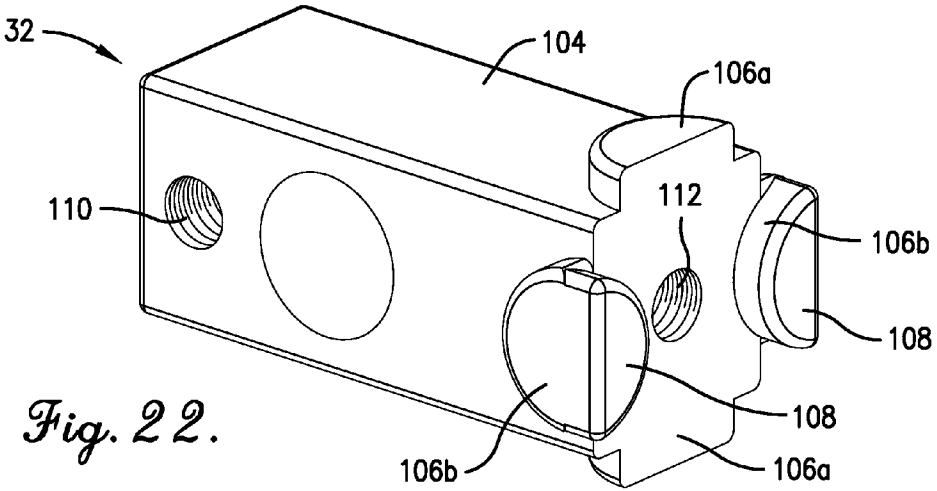
FIG. 22 is a perspective view of a second end of the thumbscrew connector of FIG. 21.

As illustrated in FIGS. 21-22, the connector 32 includes a body 104 presenting an outer profile generally conforming to a shape of the inner channel 38 of the beams 12. In the illustrated embodiment, the connector body 104 is rectangular with a square cross section such that it can slide into an end of one of the beams 12. The connector 32 further includes at least one, and preferably multiple, laterally-extending flanges 106 configured to engage an end aperture of the beam in which the connector 32 is mounted, and at least one longitudinally-extending flange 108 configured to engage a second part to which the connector 32 is connected. In some embodiments, the connector 32 includes four laterally-extending flanges 106, one placed on each side of the connector 32, to engage each of the four end apertures 44 of the beam 12 to which the connector 32 is connected. In some embodiments, the connector 32 includes two longitudinally-extending flanges 108 that extend from the end of the connector 32 proximate the laterally-extending flanges 106. The size, shape and placement of the longitudinally-extending flanges 108 may be similar to the size, shape and placement of the flanges 88, 90 of the first connector 28, such that the longitudinally extending flanges 108 are each configured to engage a different large aperture 40, 40' of the second part to which the connector 32 is connected.

The connector 32 includes a first threaded receptacle 110 that aligns with one of the small apertures 42, 42' of a beam 12 when the connector 32 is seated in the inner channel 38 of the beam 12, and a second threaded receptacle 112 that aligns with a small aperture 42, 42' in the second part when the connector 32 engages the second part. The first threaded receptacle 110 is located on a side of the connector 32 while the second threaded receptacle 112 is located on the end of the connector 32. When the connector 32 is seated in the beam 12 and engages the second part, a first thumbscrew 84 is inserted through a small aperture in the beam 12 and into the first threaded receptacle 110 to secure the connector 32 to the beam 12, and a second thumbscrew 84 is inserted through a small aperture in the part and into the second threaded receptacle 112 to secure the connector 32 to the part. This configuration is illustrated in FIGS. 1-3. The connector 32 may also include a through-hole 114 positioned to be in register with one of the large apertures 40, 40' of the beam 12 when the connector 32 is seated in the beam 12. The through-hole 114 may be about the same diameter as the large apertures 40, 40'.

Figure 24:
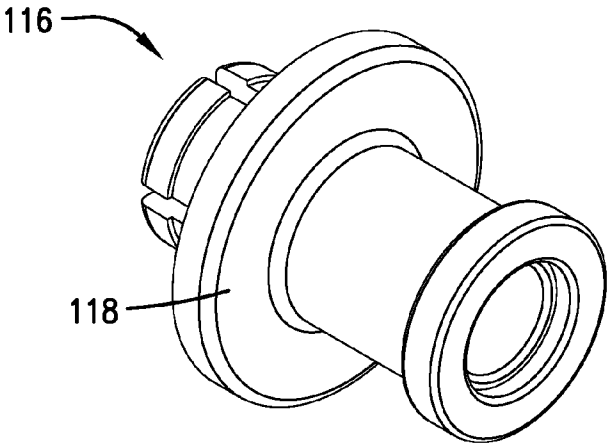
FIG. 24 is a perspective view of a second end of the connector of FIG. 23.
Figure 23:
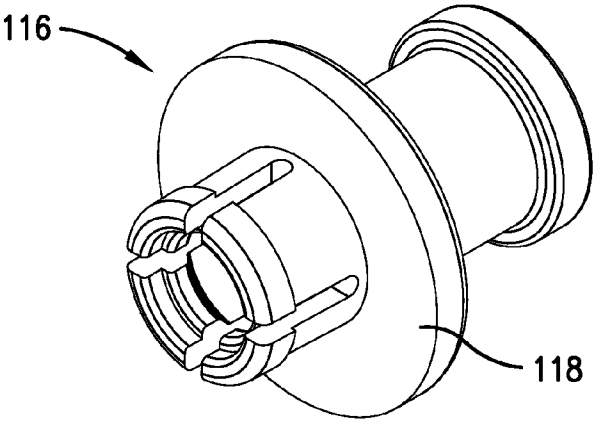
FIG. 23 is a perspective view of a first end of another expansion connector for use with the building system of FIG. 1.

The plate connector 34 may be used to connect a first beam 12 to a second beam 12 in a "T" configuration, as illustrated in FIGS. 1-3. The plate connector 34 presents a planar profile with a first set of large and small apertures arranged in an alternating linear configuration. A second set of large and small apertures are arranged in an alternating linear configuration that is perpendicular to the first set of apertures. A second expansion connector 116 is illustrated in FIGS. 23 and 24. The second expansion connector 116 is identical to the expansion connector 26 described above, except that the second expansion connector 116 has a round base 118 and no alignment posts.

Figure 25:
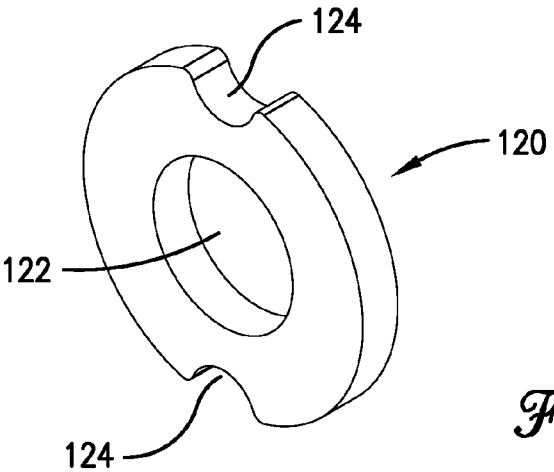
FIG. 25 is a perspective view of a spacer configured for use with the building system of FIG. 1.

The building system 10 may also include a spacer 120 illustrated in FIG. 25. The spacer 120 may be used to fill gaps between system parts and, therefore, is preferably as thick as the walls of the other system parts. The spacer 120 includes an aperture 122 and a pair of opposed recesses 124. The aperture 122 may be approximately the same size and shape as the large apertures 40, 40'. When the aperture 122 is placed in register with one of the large apertures 40 or 40', the recesses 124 correspond to small apertures 42 or 42' on either side of the large aperture.

Although the invention has been described with reference to the preferred embodiment illustrated in the attached drawing figures, it is noted that equivalents may be employed and substitutions made herein without departing from the scope of the invention as recited in the claims. For example, the large and/or small apertures may be a shape other than round, such as square or triangular. Furthermore, while the expansion connector may have a single alignment post rather than two.

Having thus described the preferred embodiment of the invention, what is claimed as new and desired to be protected by Letters Patent includes the following:

1. A connector comprising: a base; an aperture in the base; an expansion element extending from a first side of the base, the expansion element including a plurality of flexible sections in circumscribing relationship to the aperture, each of the flexible sections including an outer lip extending outwardly from a portion of the section distal the base and an inwardly-extending inner lip; an alignment post extending from the first side of the base; a receptacle extending from a second side of the base and defining a through-hole in register with the aperture; and a pin configured to be inserted through the receptacle and into engagement with the expansion element, the pin configured to engage the inner lips of the expansion element and force the flexible sections outward.

2. The connector of claim 1, the pin configured such that an end portion of the pin positioned to engage the inner lips comprises a plurality of flexible fingers that flex inwardly when engaging the inner lips and urge the flexible sections outward.

3. The connector of claim 2, each of the flexible fingers including an outwardly-extending lip.

4. The connector of claim 1, the pin including a head portion and a shank portion, the head portion configured to engage the receptacle when the pin is fully inserted and an end of the pin aligns with an end of the expansion element.

5. The connector of claim 4, the head of the pin including a receptacle configured to receive and mate with an external component.

6. The connector of claim 1, the alignment post being one of a pair of alignment posts extending from the first side of the base.

7. The connector of claim 6, the alignment posts and the expansion element being arranged in a linear configuration with the alignment posts on opposite sides of the expansion component and each of the alignment posts being separated from the expansion component by a space.

8. The connector of claim 7, each of the alignment posts presenting a cylindrical outer profile with an outer diameter that is less than one-half of an outer dimension of the expansion component.

9. The connector of claim 1, the receptacle including a cylindrical wall and an outwardly-extending annular flange located on a portion of the cylindrical all distal the base.

10. A building system comprising: a first part including a wall defining a first aperture and a second aperture; a second part including a wall defining a first aperture and a second aperture; and a connector including—a base with a base aperture, an expansion element extending from a first side of the base, the expansion element including a plurality of flexible sections in circumscribing relationship to the base aperture, each of the flexible sections including an outer lip extending outwardly from the section, the expansion element configured to be inserted through the first aperture of the first part and the first aperture of the second part such that the wall of the first part and the wall of the second part are locked into position between the base and the outer lips, an alignment post extending from the first side of the base and configured to engage the second aperture of the first part and the second aperture of the second part when the expansion component is in locking relationship with the first wall and the second wall, a receptacle projecting from a second side of the base and defining a through-hole in register with the base aperture, and a pin slidably positioned within the receptacle such that a portion of the pin extends through the base aperture and forces at least a portion of each of the flexible sections outward such that the outer lips define an outer perimeter that is larger than a radius of each of the first apertures of the first and second parts.

11. A building system comprising: a first part including a wall with a plurality of uniform large apertures and a plurality of uniform small apertures, the apertures being arranged according to a pattern wherein each of the small apertures is proximate at least one of the large apertures; a connector including—a base; a first flange extending from a first side of the base and configured to engage any one of the large apertures, and a threaded receptacle in the base positioned to be in register with one of the small apertures when the first flange engages any of the large apertures; and a thumbscrew with a head and a shank, at least a portion of the shank being threaded, the shank configured to extend through any one of the small apertures and to fixedly engage the threaded receptacle of the connector.

12. The building system of claim 11, further comprising—a second part including a wall with a plurality of large apertures and a plurality of small apertures identical in size, shape and placement pattern to the large apertures and the small apertures of the first structural element, the connector being configured such that the first flange simultaneously engages a large aperture of the first structural element and a large aperture of the second structural element when the apertures are placed in a stacked relationship the thumbscrew being configured such that a shank of the thumbscrew extends through both parts and fixedly engages the threaded receptacle of the connector, thereby fixedly connecting the first and second parts to the connector.

13. The building system of claim 11, the connector further comprising a second flange configured such that the first flange and the second flange simultaneously engage different large apertures on the first part.

14. The building system of claim 13, the first flange and the second flange being positioned on opposite sides of the threaded receptacle.

15. The building system of claim 11, the apertures being arranged according to an alternating pattern wherein each of the small apertures is separated from each adjacent small aperture by a large aperture.

16. The building system of claim 11, the large apertures and the small apertures presenting a round shape, the diameter of the small apertures being less than one-half of the diameter of the large apertures.

17. The building system of claim 11, the base including an aperture and the first flange being configured to at least partially circumscribe the aperture.

18. The building system of claim 17, the connector further including an annular wall extending from a second side of the base, the annular wall defining a through-hole that is in register with the aperture.

* * * * *